US006106360A

United States Patent [19]

Jenkins et al.

[11] Patent Number: 6,106,360

[45] Date of Patent: Aug. 22, 2000

[54] DOLL

[76] Inventors: Donna Joy Jenkins, P.O. Box 3162, Omak, Wash. 98841-3162; Vera Signe Lundberg, 3101 Boardwalk, II-2811, Atlantic City, N.J. 08401

[21] Appl. No.: 09/245,767

[22] Filed: Feb. 5, 1999

[51] Int. Cl.[7] ..... A63H 3/02; A63H 3/12; A47C 20/00

[52] U.S. Cl. ..... 446/369; 446/72; 446/321; D6/599; 5/639

[58] Field of Search ..... 446/71–77, 321, 446/369, 372; 434/236, 238, 427; D6/599, 598; 5/636, 639, 485, 490

[56] References Cited

U.S. PATENT DOCUMENTS

| | | | |
|---|---|---|---|
| D. 306,889 | 3/1990 | Fiust | D21/149 |
| D. 308,401 | 6/1990 | Dinelli | D21/149 |
| D. 401,984 | 12/1998 | Morrison | D21/577 |
| 1,425,974 | 8/1922 | Kearney . | |
| 1,590,927 | 6/1926 | Duncan et al. . | |
| 1,651,738 | 7/1927 | Stein et al. . | |
| 1,768,334 | 6/1930 | Stein et al. . | |
| 2,396,441 | 3/1946 | Seidler . | |
| 2,429,928 | 10/1947 | Exline . | |
| 3,811,220 | 5/1974 | Glass et al. . | |
| 4,373,292 | 2/1983 | Pelura . | |
| 4,734,948 | 4/1988 | Danova | 5/502 |
| 4,853,994 | 8/1989 | Ekstein . | |
| 4,889,512 | 12/1989 | Burnett et al. | 446/72 |
| 5,084,930 | 2/1992 | Danova | 5/502 |

*Primary Examiner*—Robert A. Hafer
*Assistant Examiner*—Laura Fossum
*Attorney, Agent, or Firm*—Wells, St. John, Roberts, Gregory & Matkin, P.S.

[57] ABSTRACT

A doll is described including a plush doll body having integral arms, legs, torso, and head. A face is provided on at least one side of the head, and at least one annular flange formed about the head and face along a coronal plane passing through the body. The flange extends radially outward of the head and loosely overlaps a portion of the torso. A pillow having a doll body receiving pocket formed therein releasably receives and covers the torso, arms, and legs such that only the head and flange are exposed outwardly of the pocket.

9 Claims, 8 Drawing Sheets

DOLL

TECHNICAL FIELD

The present invention relates generally to the field of toys and more particularly to dolls.

BACKGROUND OF THE INVENTION

Dolls have been produced and enjoyed by children and adults alike for centuries. Most dolls, however, have limited use and do not contribute much in the way of educating the owner beyond the likeness they bear to actual humans, and human expression.

An objective of our invention is to provide a doll that is attractive, and a companion to hold and carry.

Another objective is to provide a doll that is amusing and versatile while remaining relatively simple in construction.

A still further objective is to provide such a doll that can be incorporated in a series of characterizations relating to universal themes such as the heavens and earth.

A yet further objective is to provide such a doll that may be used to exemplify to a child the transition from bed time to wake-up time.

Another objective is to provide such a doll that is relatively simple in construction, inexpensive to fabricate and which is fun and positive in play value.

A still further objective is to provide a doll that is educational, contributing to expand a child's curiosity and knowledge of the environment in which we live.

These and still further objectives and advantages will become s apparent from the following detailed description and accompanying drawings, which exemplify the presently preferred mode for carrying out the invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 4:
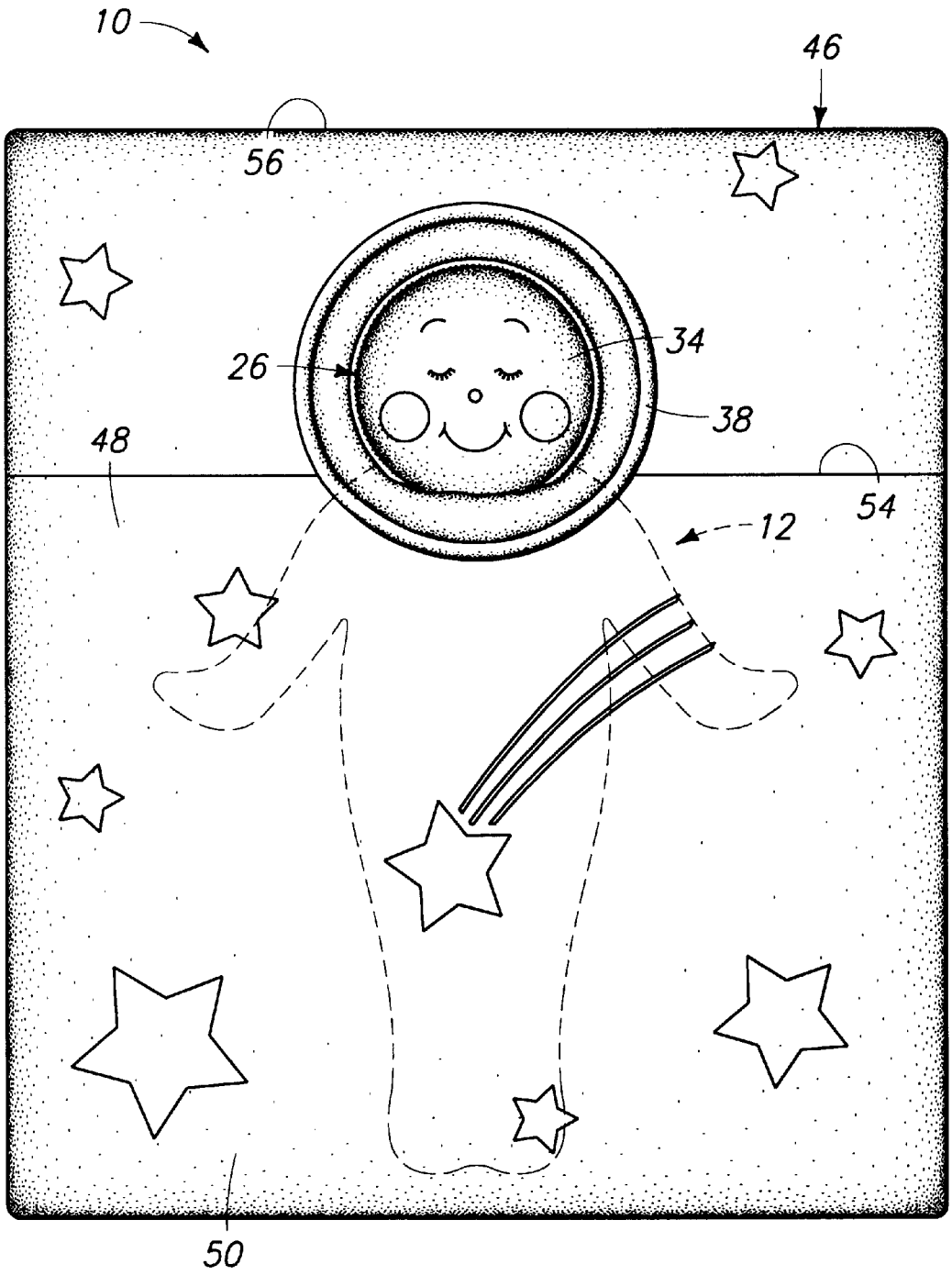
FIG. 4 is a front elevational view of a preferred doll body tucked within a pocket in a preferred pillow configuration.
Figure 5:
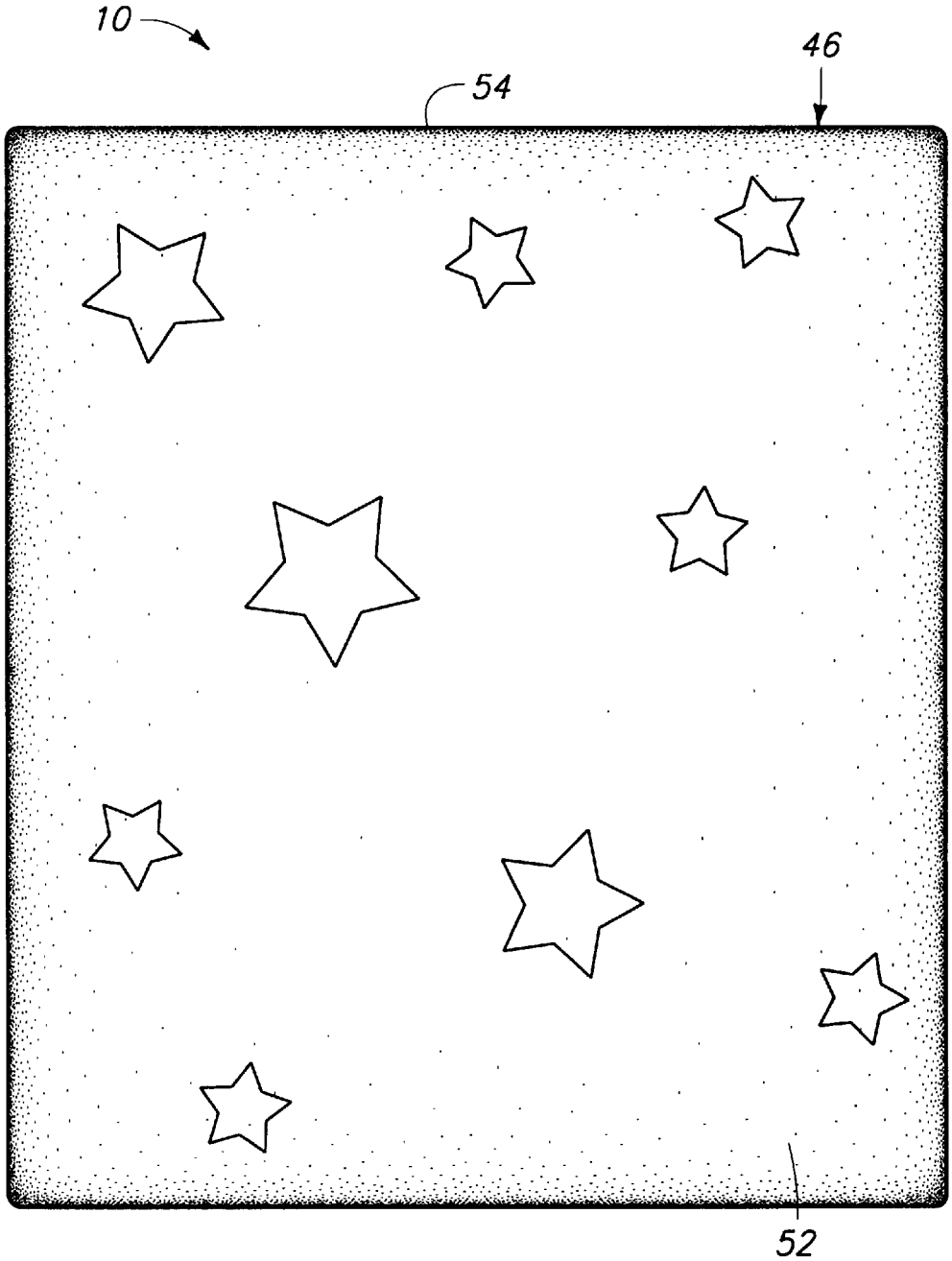
FIG. 5 is a rear elevational view of the preferred pillow.
Figure 6:
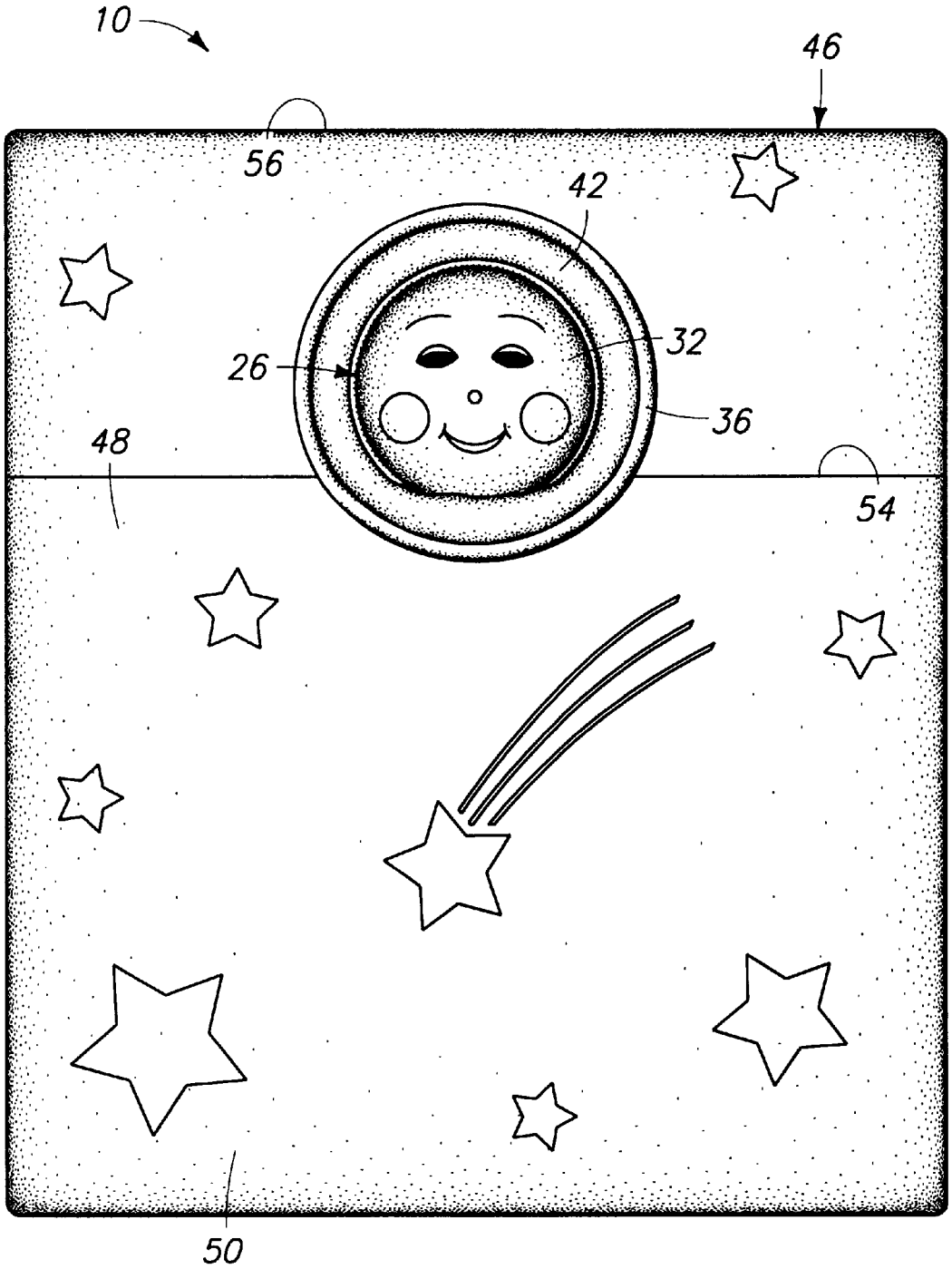
FIG. 6 is a view similar to FIG. 4 only showing an opposite side of the doll body oriented outwardly.
Figure 7:
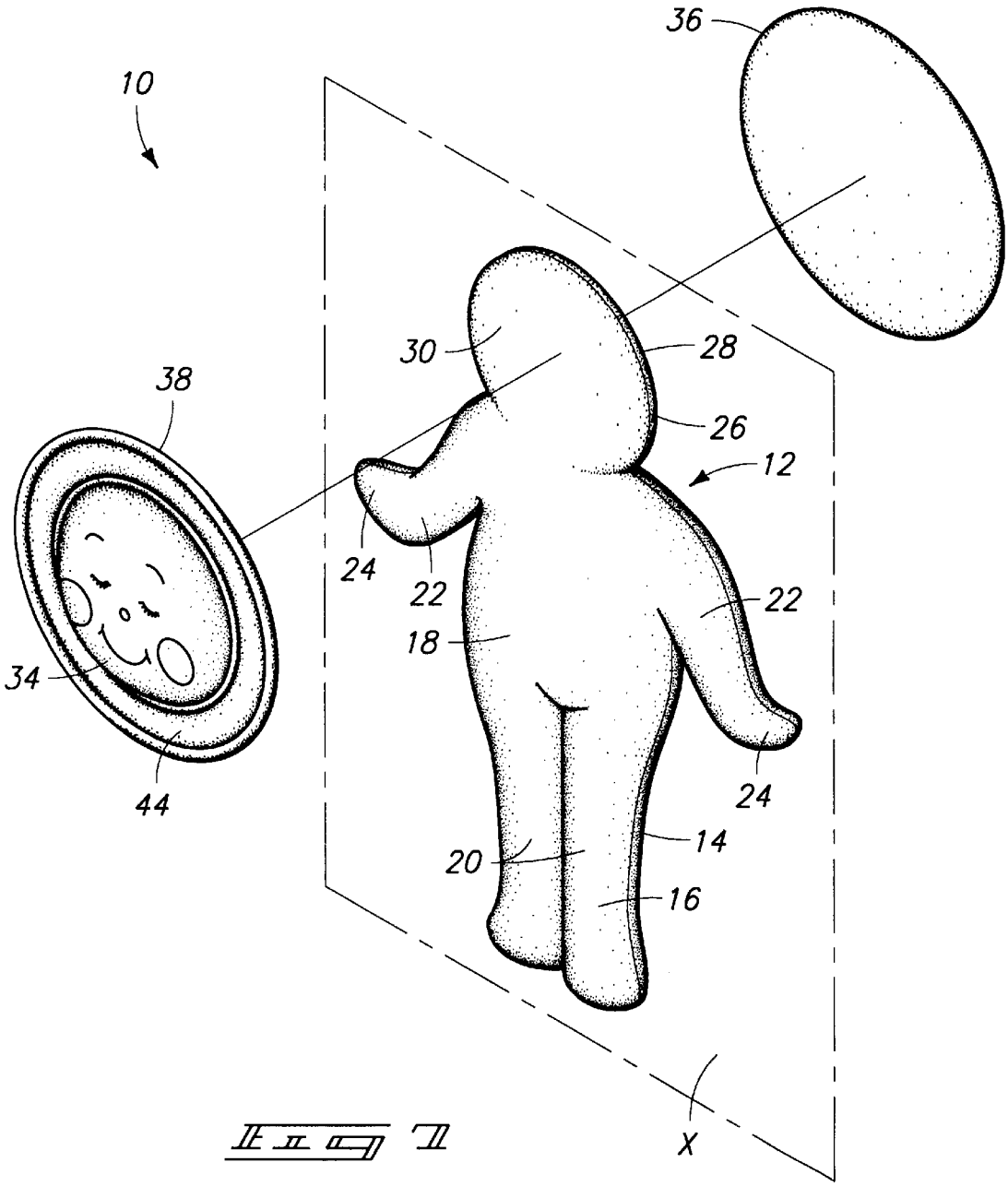
FIG. 7 is an exploded perspective view showing opposed faces and flanges relative to the head portion.
Figure 8:
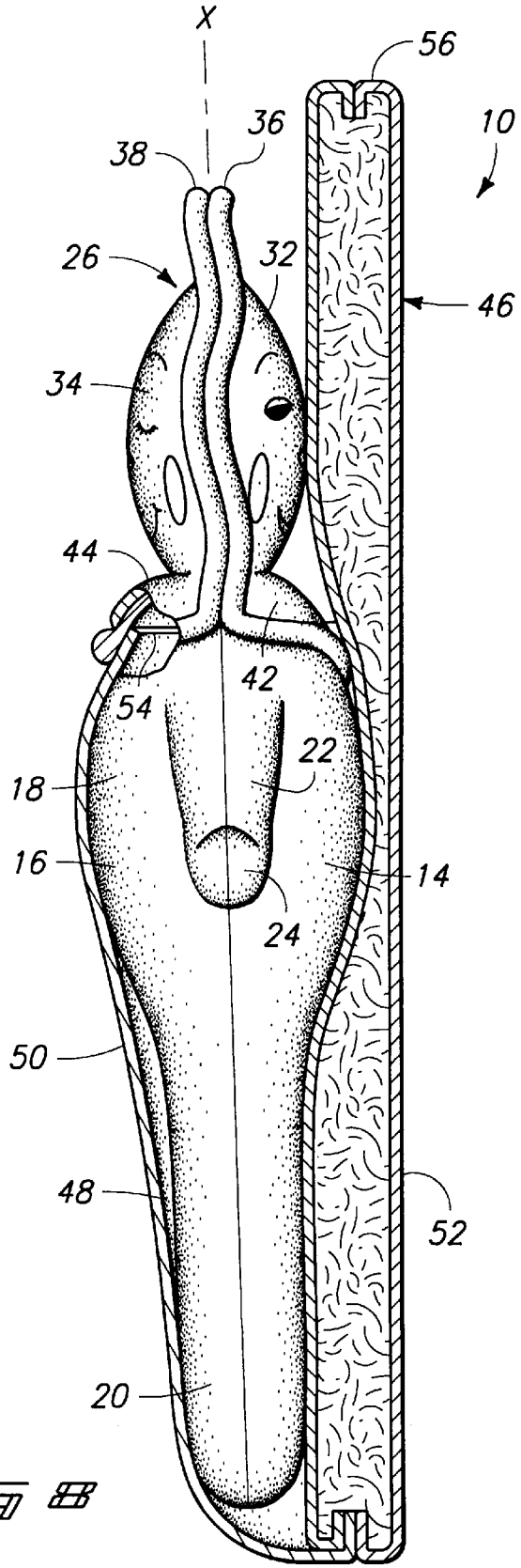
FIG. 8 is a sectional view showing the doll body within the pillow pocket.

Preferred forms of the present invention are comprised of a doll which is generally designated by reference numeral 10 in the drawings. The doll 10 may be provided in any of several configurations. In one embodiment the doll 10 includes a configuration substantially similar to that shown generally in FIG. 1 of the drawings. In another preferred embodiment, the doll includes a combination of a doll body and a pillow configuration as shown in FIGS. 4, 6, and 8. Various elements of the embodiments are similar as described in greater detail below.

It is preferred that the doll be constructed of soft plush fabric and that it be filled with an appropriate filling suitable for such toys. Appropriate fabrics and stuffing are widely known in the toy and doll industry, and are currently available on the market. It should be understood, however that other materials could be used without departing from the scope of our invention.

Figure 1:
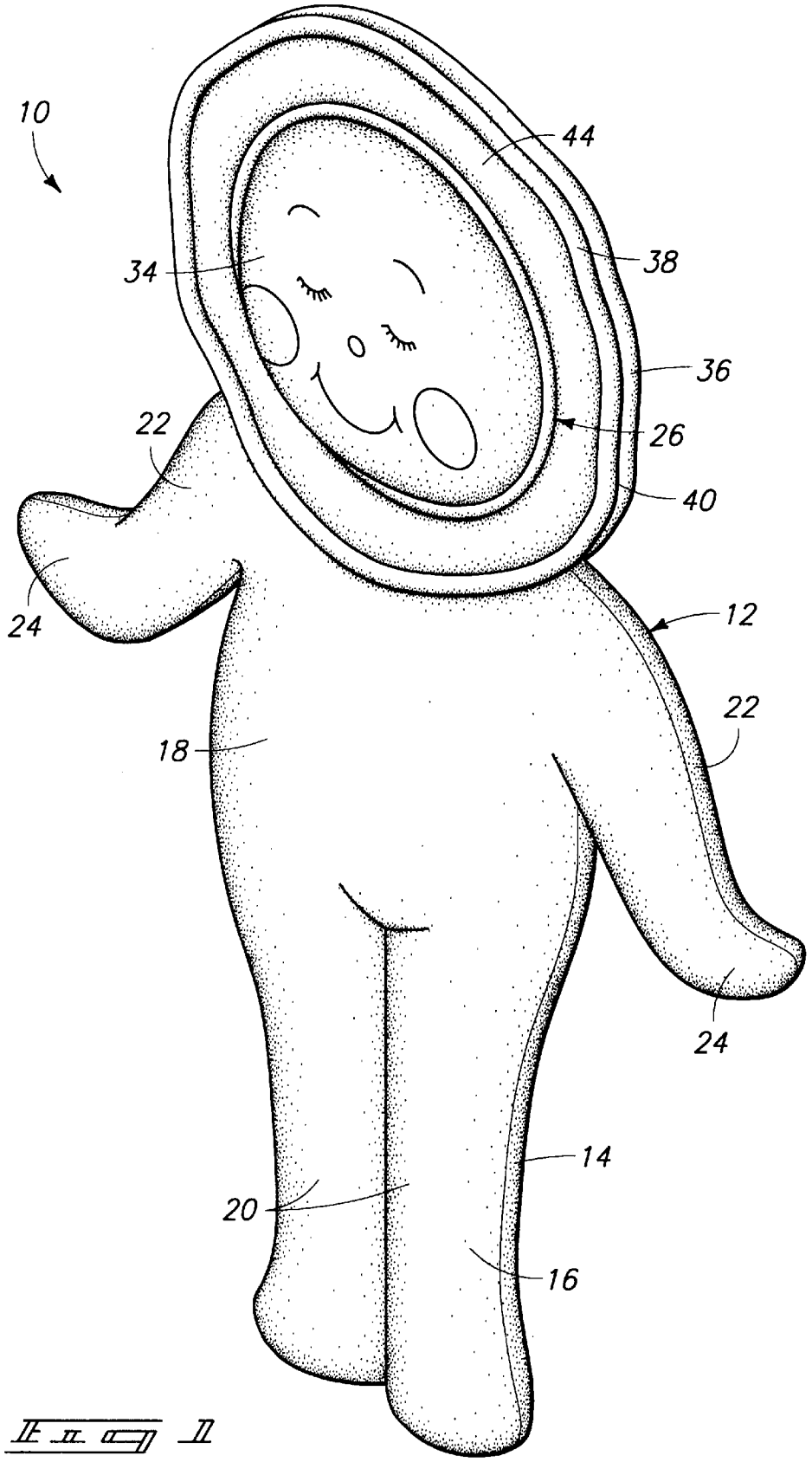
FIG. 1 is a perspective view of a doll body incorporating features of the present invention.

In the embodiment generally shown in FIG. 1, the doll 10 includes a doll body 12 with a frontal surface 14 and a back surface 16. It should be understood that the terms "frontal" and "back" are used only for descriptive purposes since the doll body is bidirectional. That is, the frontal surface 14 may be substantially identical (except for facial expressions) to the back surface 16.

In preferred forms, the body 12 further includes a torso 18, legs 20 and arms 22. The legs exemplified herein are straight and in lateral juxtaposition. The preferred arms 22 extend outwardly to upturned hands 24.

The preferred body 12 may also include an integral doll head 26 including respective opposed first and second surfaces 28, 30 on the doll body. The first surface 28 may face the same direction as the frontal surface 14 of the body, and the second surface 30 may face the same direction as the back surface 16.

Figure 3:
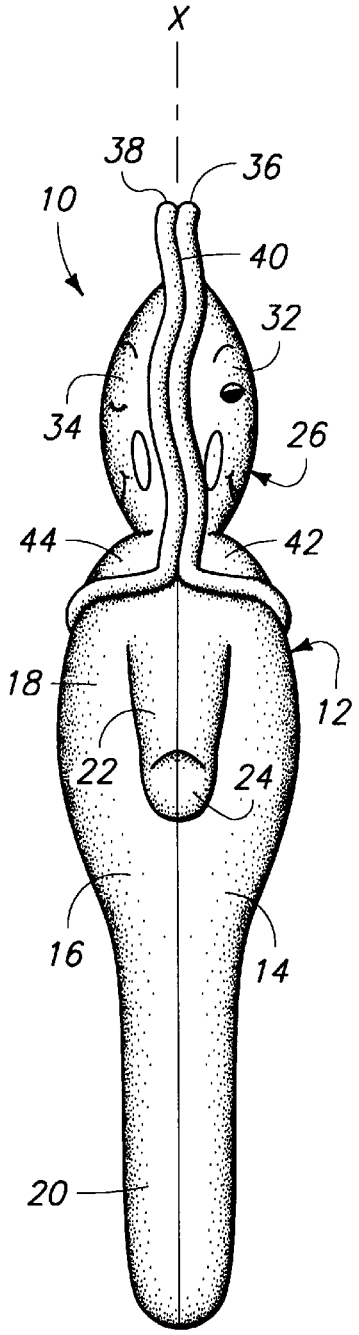
FIG. 3 is a side elevation view of the doll body.

It is advantageous for the head 26, arms 22, and legs 20 to be integral with the torso 18 to provide maximum strength and to facilitate ease of assembly. These parts may be integral on opposed surfaces of the doll and be sewn together along a coronal plane X (FIG. 3) that substantially bisects the doll body. The frontal surfaces may therefor be substantially symmetrical on the plane X with the back surfaces.

A first doll face 32 may be provided on the first surface 28 and a second doll face 34 may be likewise provided on the second surface 30. The first face 32 may be formed in a first expression, with eyes and a mouth set in a wakeful state. The second face 34 may include the same features only with a different expression, such as eyes and a mouth set in a sleeping state. Thus the doll body may be selectively turned to expose one or the other of the two facial expressions.

Figure 2:
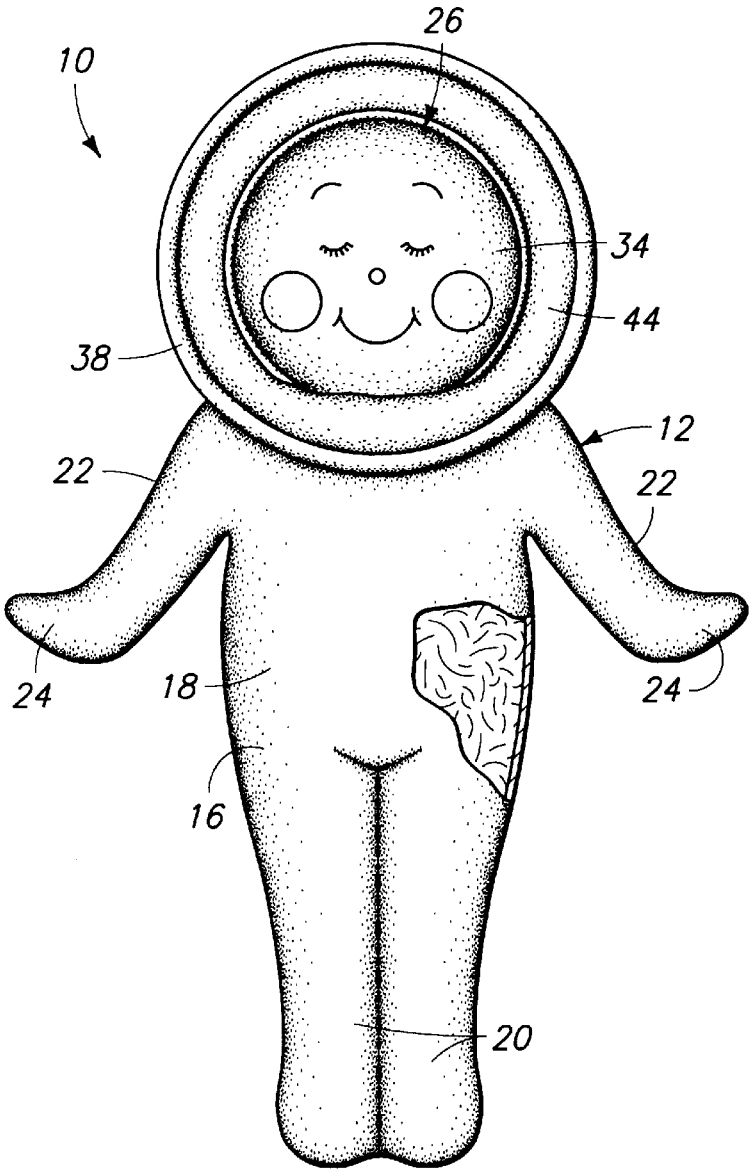
FIG. 2 is a front elevation view of the doll body with a portion thereof broken away.

In a preferred embodiment, at least one annular flange is provided, substantially encircling one of the faces. In preferred forms the flange extends entirely around the face 34 as clearly shown in FIGS. 1 and 2. More preferably, two such flanges are provided. A first annular flange 36 is formed about the first doll face 32 and extends outwardly thereof. A second annular flange 38 is formed about the second doll face 34 and extends substantially radially outward thereof. The flanges 36, 38 are advantageously disposed in axial juxtaposition and extend independently outward of the doll head to form a finger access recess 40 (FIG. 9).

Figure 9:
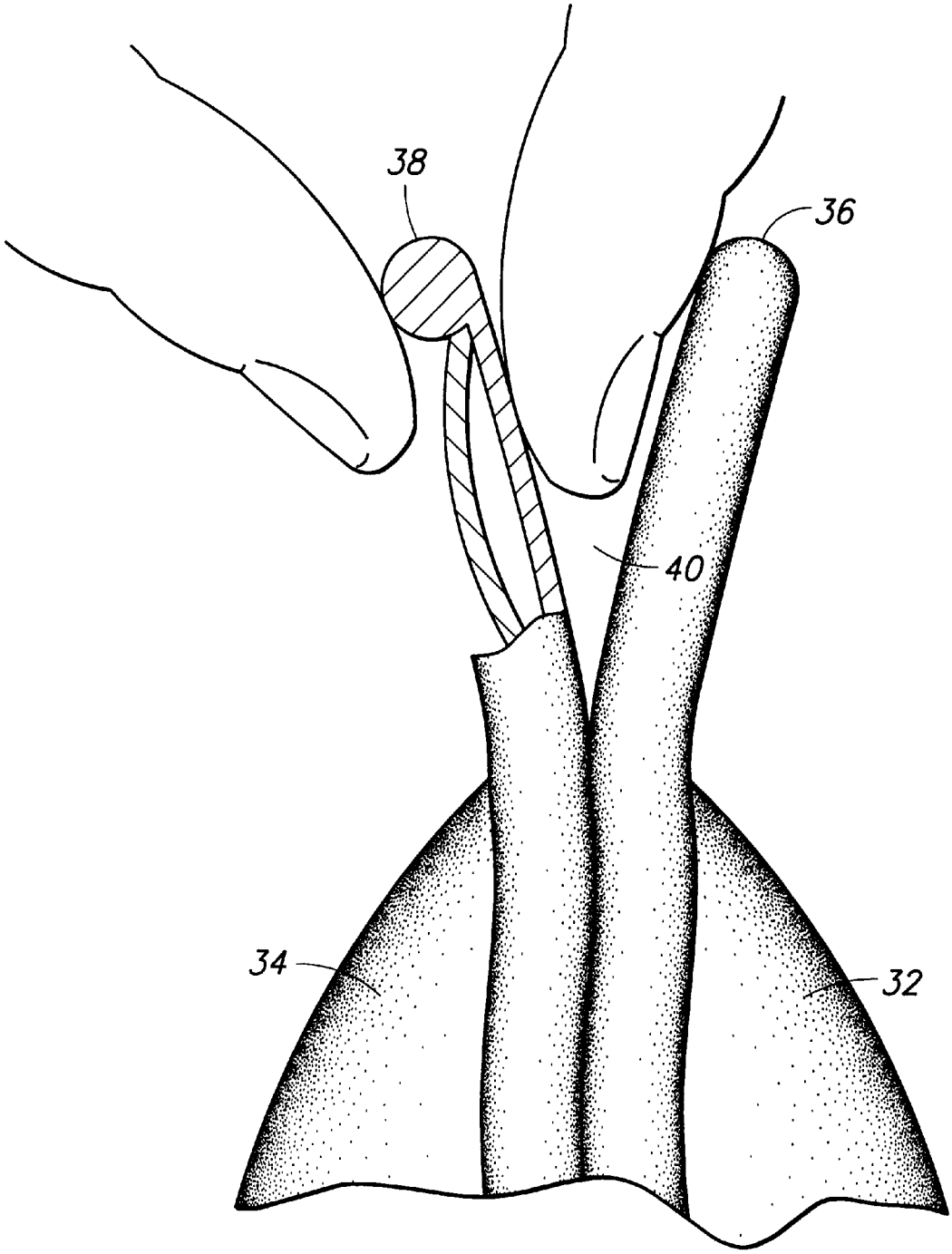
FIG. 9 is an enlarged detail view showing how one of a pair of annular flanges about the head portion of the body might be gripped between a child's fingers.

The recess 40 is useful in that it allows a child to insert fingers substantially as shown in FIG. 9 so either flange may be gripped and caressed. Secondly, the recess enables the doll head to be easily gripped by a child to facilitate removal of the doll body 12 from the pillow described below, regardless of which face 32 or 34 is facing outwardly.

In preferred embodiments, the first and second annular flanges 36, 38 include display surfaces 42, 44 substantially encircling the respective faces 32, 34. The display surfaces may be produced with visual indicia that identify a selected theme. The flange display surfaces may be supplied with indicia indicating a point of origin. A yellow surface could thus relate to the halo or light around the moon, or the circle around the sun. Triangular shapes on the flanges could be associated with the points of a star. In still another form of indicia, the flanges could be configured in the form of flower petals.

Dolls decorated with astronomical indicia could be associated with the heavens, and those decorated with, say petals, could be associated with the earth. Such indicia could also be associated with appropriate names for the doll, such as Heavenly Baby or Earth Baby, according to whatever decoration is supplied on the flanges.

In a preferred form of the present doll 10 a pillow 46 is included (FIGS. 4–6 and 8). The pillow 46 may be formed of the same materials as the doll body, and will most preferably have a doll body receiving pocket 48 formed therein. The pocket may be provided on one side of the pillow and be configured to releasably receive and cover the torso, arms, and legs, such that only the head and one of flanges are exposed outwardly of the pocket. This condition is exemplified in FIGS. 4 and 6.

The preferred pillow includes a front surface 50 and a back surface 52. The doll body receiving pocket 48 is formed on one of the surfaces. Pocket 48 may be formed by a flap of the pillow material that is folded upwardly to overlap part of the pillow, with side edges sewn along similar side edges of the pillow. A top edge 54 of the pocket preferably spans the pillow and is situated downwardly of a top edge 56 of the pillow. Thus formed, the pillow is configured to releasably receive and cover the torso, arms, and legs, of the doll body such that only the head and one of the flanges are exposed outwardly of the pocket (see FIGS. 4 and 6).

It should be noted that two pockets could be supplied, one on each side of the pillow. Such pockets could be substantially identical to that shown, and either would readily receive a doll body in the manner described above.

Preferably, at least the front side of the pillow will include a display surface configured to display indicia identifying a selected theme, much in the manner described above for the annular flanges 36, 38. In the example illustrated, the indicia placed on the front surface 50 includes stars to create a night time sky image. The star images cover the pocket and front surface of the pillow above the top pocket edge 54. Thus when the doll body is inserted in the pocket, the head and exposed flange become part of the overall design. In the example illustrated, the head and flange appear as a moon in the night sky.

In another example (not illustrated) cloud shapes could be used to decorate the pillow and the doll head and flange could be identified with the sun. In still another example flowers could be used to decorate the pillow and the doll head and flange (provided as petals) could be identified as a flower in a garden.

Of course, the user has a choice of pulling the doll body from the pillow for play purposes, or for turning the doll body and re-inserting it into the pocket in order to show the opposite face. Thus the doll may be used to show, for example, a sleeping baby as shown in FIG. 4, or an awake baby as shown in FIG. 6. Arranging the doll body with either of the selected faces showing is a fun and educational practice for a child, plus the expressions on the doll faces can be used to identify with different daily time situations. For example, the doll body could be arranged in the pocket with the sleeping face outward to identify nap time or bed time. The wakeful condition would likewise denote wakeful times.

In sightly more complex versions, the flange display surfaces 42 on opposite sides of the doll body could be decorated differently. For example the flange on one side (the side with a wakeful facial expression), could be simply colored bright yellow to identify with the sun. One side of the pillow could likewise be provided with daytime sky images, such as clouds. The flange on the other side of the doll body (the side with a sleeping facial expression) could be provided with star points to identify with a star in the night sky. The other side of the pillow (and a second pocket formed thereon) could be provided with night time images such as stars and the moon. Such images could be selectively identified by the child and the doll body could be turned and inserted into a selected pocket as a match for the day or night time condition, sleep at night, awake during day.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A doll, comprising:

a doll body including arms, legs, torso, and head;

a face on at least one side of the head;

an annular flange extending continuously around the face of the doll;

pillow including a pocket positioned along a front surface thereof dimensioned to releasably receive the doll body such that the face and annular flange are exposed outwardly of the pocket, while the arms, legs and torso are received within and covered by the pocket; and indicia on the front surface of the pillow, the face of the doll, and annular flange, together visually indicating an illustrated theme when the doll is received in the pocket of the pillow.

2. The doll according to claim 1, in which the arms extend outwardly and terminate in hands that are tipped upwardly from the arms.

3. The doll according to claim 1 in which the legs are integral and positioned together in juxtaposition.

4. The doll according to claim 1 wherein the doll body, head and flange are substantially symmetrical to opposite sides of a coronal plane.

5. The doll according to claim 1 wherein the face includes eyes and a mouth set in a wakeful state and a second face on an opposite side of the doll which includes eyes and a mouth set in a sleeping state.

6. The doll according to claim 1 wherein the flange includes first and second annular flanges that are formed of soft plush fabric.

7. The doll according to claim 1 wherein the flange includes first and second annular flanges having display surfaces.

8. The doll according to claim 1 wherein the flange includes first and second annular flanges disposed in axial juxtaposition and extending independently outward of the doll head to form a finger access recess.

9. The doll according to claim 1 wherein the pillow is plush and further includes a back surface; and wherein the doll body receiving pocket is formed at least on the front surface by a flap of material that overlaps part of the pillow.

* * * * *

UNITED STATES PATENT AND TRADEMARK OFFICE

CERTIFICATE OF CORRECTION

PATENT NO : 6,106,360

DATED : August 22, 2000

INVENTOR(S) : Donna Joy Jenkins and Vera Signe Lundberg

It is certified that error appears in the above-identified patent and that said Letters Patent are hereby corrected as shown below:

Col. 1, l 32: Delete the "s" after the word "become".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*